US008113906B2

(12) United States Patent
Cohen

(10) Patent No.: US 8,113,906 B2
(45) Date of Patent: Feb. 14, 2012

(54) AIR BLOWN NOISEMAKER

(76) Inventor: Wayne Cohen, Bangkok (TH)

( * ) Notice: Subject to any disclaimer, the term of this patent is extended or adjusted under 35 U.S.C. 154(b) by 531 days.

(21) Appl. No.: 12/184,362

(22) Filed: Aug. 1, 2008

(65) Prior Publication Data

US 2010/0024713 A1 Feb. 4, 2010

(51) Int. Cl.
*G10K 9/04* (2006.01)

(52) U.S. Cl. ..... 446/202; 446/213; 446/416; 116/142 R; 84/330

(58) Field of Classification Search ..... 446/202, 446/204, 207, 213, 216, 416; 116/142 FP, 116/142 R, 137 R; 84/330
See application file for complete search history.

(56) References Cited

U.S. PATENT DOCUMENTS 2,700,316 A * 1/1955 Gordon et al. ..... 84/330
2,789,529 A * 4/1957 Broden ..... 116/142 R
3,484,799 A * 12/1969 Murtaugh et al. ..... 446/202
5,049,107 A * 9/1991 De Nittis ..... 446/397
5,460,116 A 10/1995 Gyorgy
5,662,064 A 9/1997 Gyorgy
6,250,247 B1 * 6/2001 Chu ..... 116/137 R
6,346,664 B1 * 2/2002 Shuen ..... 84/402
7,389,740 B2 * 6/2008 Wishinsky ..... 116/142 FP
2006/0243190 A1 * 11/2006 Cohen ..... 116/137 R

* cited by examiner

*Primary Examiner* — Gene Kim
*Assistant Examiner* — Scott Young
(74) *Attorney, Agent, or Firm* — LaMorte & Associates, P.C.

(57) ABSTRACT

A noisemaker assembly that includes an annular horn body having an inner wall, an outer wall and a groove disposed there between. The groove is open at the top surface of the horn body. A tubular mouthpiece is provided that extends into the horn body. The mouthpiece communicates with the groove inside the horn body. When air is blown into the mouthpiece, that air passes into the groove within the horn body. A membrane is placed over the horn body so that the membrane covers the top of the groove. When air is blown into the groove, the air slips past the membrane from inside the groove. This causes the membrane to vibrate and generate a loud low frequency noise. The horn assembly can be held within a housing. The housing has perforations to enable sound energy from the horn assembly to escape from the housing.

7 Claims, 3 Drawing Sheets

AIR BLOWN NOISEMAKER

BACKGROUND OF THE INVENTION

1. Field of the Invention

In general, the present invention relates to noisemakers that operate by having air blown into the noisemaker. More particularly, the present invention relates to the structure of such noisemakers and assemblies where such noisemakers are encased in a housing.

2. Prior Art Description

The prior art is replete with novelty devices that are designed to make noise. Once class of such novelty devices is the noisemaker with a vibrating membrane. A kazoo is an obvious example of a noisemaker that uses a vibrating membrane. In a kazoo, air is directed past a flat membrane. The passing air causes the membrane to vibrate and the membrane to create noise. Noisemakers with vibrating membranes typically make pleasant low frequency sounds that are not shrill to the human ear.

A problem associated with many prior art noisemakers that contain vibrating membranes is that the volume of the noise that can be created is limited. If a person blows into a prior art noisemaker too hard, the rush of air tends to displace the membrane and prevent the membrane from vibrating at all. Consequently, if a person blows too hard into the noisemaker, instead of making a louder noise, the noisemaker fails to make noise at all.

If it is desired to make very loud noises, noisemakers with vibrating membranes are typically not used. Rather, noisemakers such as whistles are used that produce noise without a membrane. The problem associated with whistles and similar devices is that the frequency of the noise is high and the sound of the noise tends to be shrill and painful to the ears, especially when at a high volume. Accordingly, whistles are good for use by referees and lifeguards that need to be quickly heard in a loud environment. However, no one would want to sit next to a person in a stadium who was blowing a whistle just to cheer and make noise.

During sporting events, many fans cheer and make noise. Many fans bring noisemakers to help them cheer. Noisemakers with vibrating membranes are typically not used they produce noise that is too soft. Whistles are not commonly used because the whistle is too shrill and offends surrounding fans. Furthermore, whistles are often prohibited because they confuse the players who my think the whistle sound came from an official.

Noisemakers have been invented that utilize vibrating membranes. Such noisemakers are exemplified by U.S. Pat. No. 5,460,116 to Gyorgy, entitled Horn For Sports fans, and U.S. Pat. No. 5,662,064 to Gyorgy, entitled High Acoustic Output Horn. A problem associated with such noisemakers is one of manufacturing cost. In such prior art noisemakers, two separate tube must be concentrically assembled. The membrane must then be attached to the concentric tube assembly with a separate collar. As such, the noisemaker has many parts and requires a large amount of hand assembly during manufacture. This makes such prior art noisemakers expensive and poorly suited for sport event give-aways and promotions.

A need exists for a noisemaker that is specifically designed to meet the needs of a cheering fan, wherein the noisemaker makes a noise that is very loud, but has a low frequency that is not shrill and painful to surrounding fans. A need also exists for such a noisemaker that is very inexpensive so that it can be given away or sold cheaply at large sporting events. Lastly, a need exists for such a noisemaker that is small and simple to operate so that a fan can use the noisemaker while seated in a stadium.

These needs are met by the present invention as described and claimed below.

SUMMARY OF THE INVENTION

The present invention is a noisemaker assembly that produces a loud low frequency sound when air is blown into the assembly. The noisemaker includes an annular horn body having a top surface, a bottom surface, an inner wall, an outer wall and a groove disposed in between said inner wall and said outer wall. The groove is open at the top surface of said horn body. The horn body is injection molded and requires no assembly.

A tubular mouthpiece is provided that extends into the horn body. The mouthpiece defines a conduit that directly communicates with the groove inside the horn body. In this manner, when air is blown into the mouthpiece, that air passes into the groove within the horn body.

A membrane is placed over the horn body so that the membrane covers the top of the groove. The membrane is configured to directly engage the horn body without any secondary attachment parts. When air is blown into the groove, the air slips past the membrane from inside the groove. This causes the membrane to vibrate and generate a loud, low-frequency noise.

The horn assembly can be held within a housing. The housing has perforations to enable sound energy from the horn assembly to escape from the housing. The housing is preferably shaped as a sports ball.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be configured into many sound generating devices, such as a foghorn or a pneumatic alarm, the present invention is especially well suited in forming a novelty noisemaker for personal use. Accordingly, the present invention is illustrated and described being embodied as a novelty noisemaker in order to set forth the best mode contemplated for the present invention.

Figure 1:
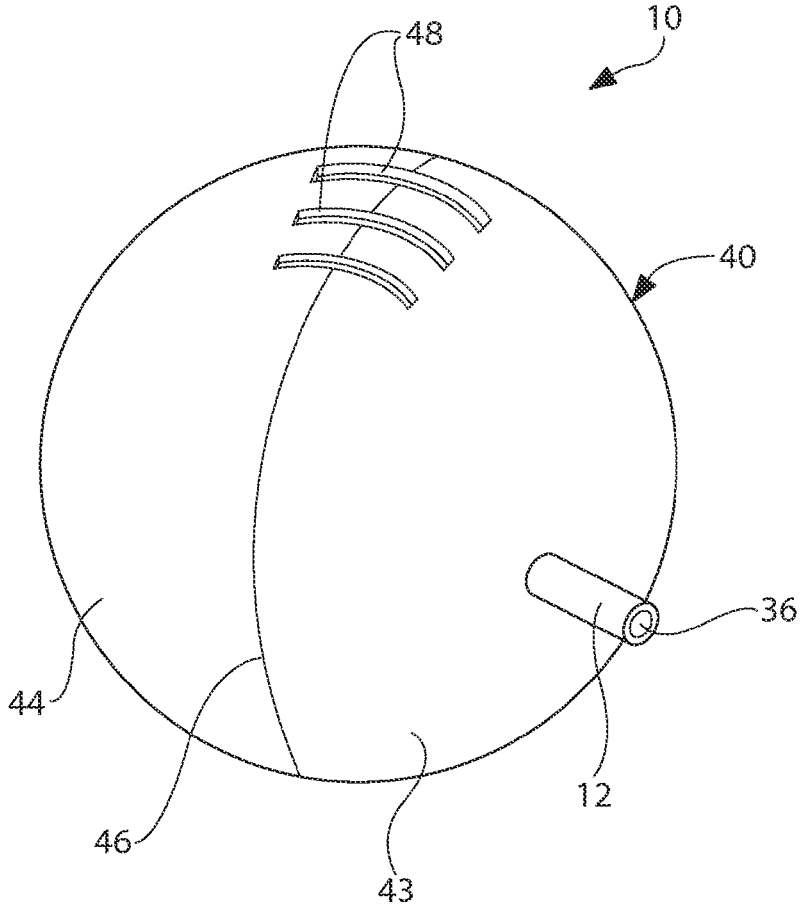
FIG. 1 is a perspective view of an exemplary embodiment of a novelty noisemaker.
Figure 2:
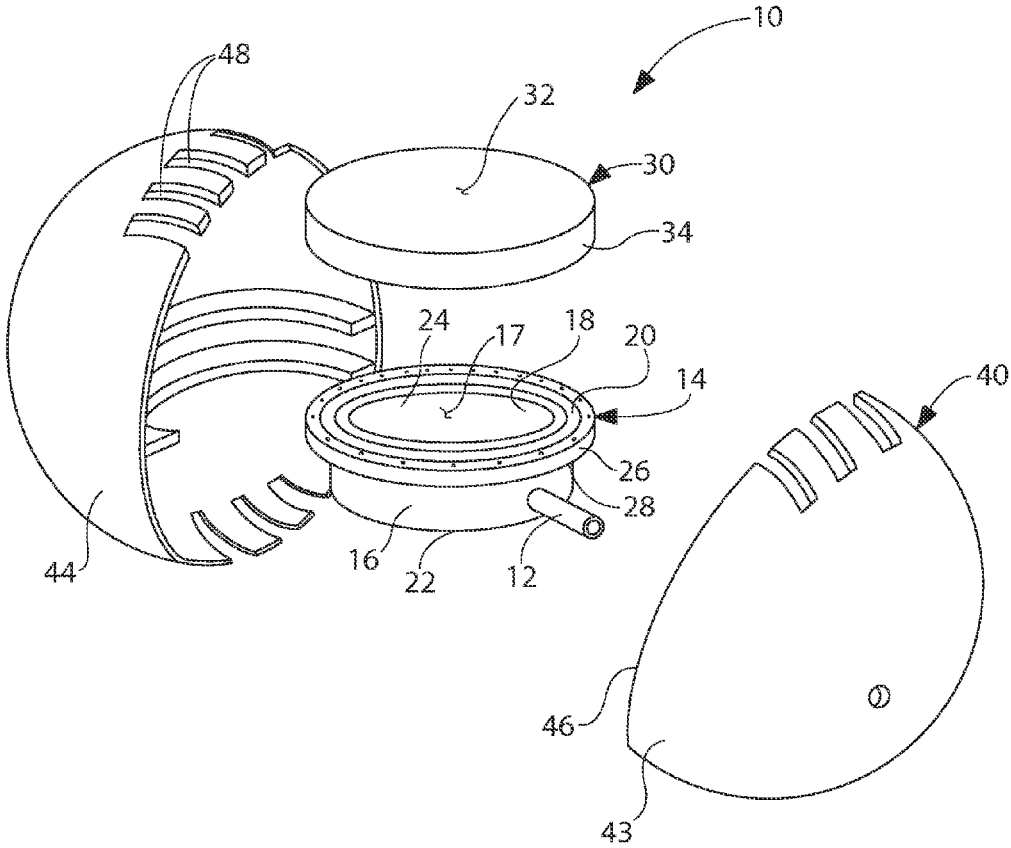
FIG. 2 is an exploded view of the embodiment of FIG. 1.
Figure 3:
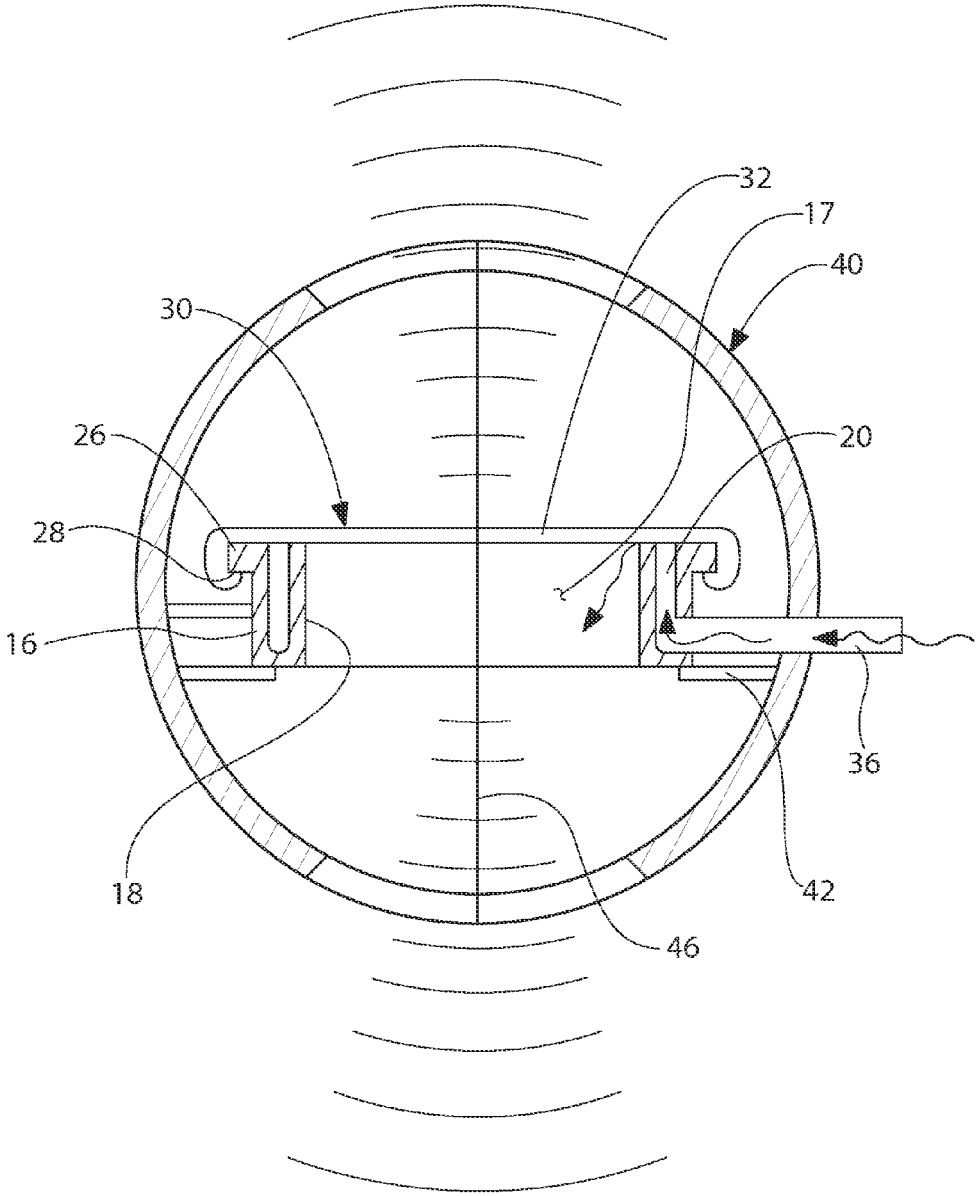
FIG. 3 is a cross-sectional view of the embodiment of FIG. 1.

Referring to FIG. 1 in conjunction with both FIG. 2 and FIG. 3, a novelty noisemaker 10 is shown. The noisemaker 10 is operated by blowing air into the noisemaker 10. The noisemaker 10 is provided with a tubular mouthpiece 12 to facilitate the blowing of air into the noisemaker 10 by the user's mouth.

The tubular mouthpiece 12 is coupled to a horn body 14. The horn body 14 is an annular structure that surrounds a central horn hollow 17. The horn body 14 is comprised of a cylindrical outer wall 16 and a generally cylindrical inner wall 18. An annular groove 20 is disposed in between the outer wall 16 of the horn body 14 and the inner wall 18 of the horn body 14. The horn body 14 has a closed bottom surface 22 in between the outer wall 16 and the inner wall 18. Accordingly, it will be understood that the annular grove 20 is defined on three sides, by the outer wall 16, the inner wall 18 and the bottom surface 22. The horn body 14 has an open top 24. It will therefore be understood that the annular groove 20 can be accessed through the open top 24 of the horn body 14.

A brim overhang 26 is disposed around the outer wall 16 just under the open top 24. The brim overhang 26 defines a ledge 28 that is used to secure an elastomeric membrane 30 into place, as will later be described.

The horn body 14 is a single injected molded piece of plastic. The tubular mouthpiece 12 can be molded as part of the horn body 12. However, significant tooling costs are saved by gluing the tubular mouthpiece onto the horn body 14 after the horn body 14 is molded.

In the shown embodiment, one elastomeric membrane 30 is provided. The elastomeric membrane 30 has a flat central area 32 that is sized to fit over the open top 24 of the horn body 14. In the shown embodiment, the horn body 14 has a circular shaped top. Accordingly, the flat central area 32 of the elastomeric membrane 30 is also circular so that it can be uniformly stretched over the open top 24 of the horn body 14 without buckling. A thickened peripheral lip 34 extends downwardly from the edges of the flat central area 32. The thickened peripheral lip 34 enables the electrometric membrane 30 to stretch over the open top 24 of the horn body 14 and engage the outer wall 16 of the horn body 14, thereby holding the elastomeric membrane 30 into a locked position. The thickened peripheral lip 34 extends over, and engages, the ledge 28 created by the brim overhang 26. In this manner, the flat central area 32 of the elastomeric membrane 30 is pulled and kept taut over the open top 24 of the horn body 14.

Once the elastomeric membrane 30 is attached over the open top 24 of the horn body 14, the flat central area 32 of the elastomeric membrane 30 lays flat against both the top of the cylindrical inner wall 18 and the top of the cylindrical outer wall 16. The flat central area 32 of the elastomeric membrane 30, therefore, covers the open top 24 of the annular groove 20, thereby isolating the annular groove 20.

The tubular mouthpiece 12 defines an open conduit 36 through which blown air can pass. The open conduit 36 extends through the outer wall 16 of the horn body 14. The open conduit 36 of the tubular mouthpiece 12, therefore, communicates with the annular groove 20 inside the horn body 14. When the user blows air into the mouthpiece 12, the air pressure inside the annular groove 20 increases. The annular groove 20 is confined by the inner cylindrical wall 18, the outer cylindrical wall 16, the bottom surface 22 and the elastomeric membrane 30 that is stretched taut over the top of the annular groove 20. The inner cylindrical wall 18, the outer cylindrical wall 16 and the bottom surface 22 are inflexible solid surfaces through which air cannot pass. Air within the annular groove 20, therefore, can only escape the annular groove 20 by displacing the elastomeric membrane 30.

When the air pressure within the annular grove 20 becomes great enough to displace the elastomeric membrane 30, the air passes over the cylindrical inner wall 18 and into the central horn hollow 17. As the air displaces the elastomeric membrane 30, the air causes the elastomeric membrane 30 to vibrate. This vibration is directly converted into sound energy. The sound energy is directed both upward and downward away from the flat central area 32 of the elastomeric membrane 30.

In a preferred embodiment, the inner wall 18 of the horn body 14 can be slightly tapered. This shape provides a slight amplification to the sound energy.

The horn body 14 is held within a housing 40. The housing 40 acts as a resonance chamber that resonates with the sound energy, thereby amplifying and adding tonal benefits to the sound energy. The housing 40 is hollow having ribs 42 on its interior that are positioned and sized to hold the horn body 14 in a fixed position within the housing 40. The ribs 42 are shallow and engage the horn body 14. In this manner, the elastomeric membrane 30 is not encumbered by the structure of the housing 40 or the ribs 42.

In the shown embodiment, the housing 40 has a clamshell construction, wherein two opposing housing sections 43, 44 are joined together along an equatorial joint 46. The exterior of the housing 40 is preferably shaped as a sports ball or puck. In the shown embodiment, the housing 40 is shaped as a round ball, such as a soccer ball or a baseball. However, it will be understood that the housing 40 can be configured as a football, basketball, helmet, hockey puck or the like. The choice of a housing with a sports theme is described because the noisemaker 10 is particularly well suited for making noise in a stadium during a sporting event.

Perforations 48 are cut into the housing 40. The perforations 48 enable the sound energy from within the housing 40 to exit the housing 40 and be heard by people far away from the noisemaker device. It is preferred that the perforations 48 in the housing be made in two locations. One location is directly above the elastomeric membrane 30. The other direction is directly below the elastomeric membrane. In this manner, sound energy generated by the elastomeric membrane 30 has a direct path through the perforations and out of the noisemaker 10. Furthermore, by placing the perforations 48 in two opposite positions, a person grasping the noisemaker 10 will not accidentally cover the perforations 48. Furthermore, by having the perforations 48 spread across a large area, a person can selectively cover different numbers of the perforations 48, thereby enabling the user to selectively control the volume of the noisemaker 10.

It will be understood that the embodiment of the present invention that is described and illustrated shows only one exemplary embodiment of the present invention noisemaker. A person skilled in the art can make many alternate embodiments using the same technology. For instance, the horn body can be polygonal in shape, rather than circular. Likewise the shape of the housing can be changed as a matter of design choice. All such variations, modifications and alternate embodiments are intended to be included within the scope of the present invention, as defined by the claims.

What is claimed is:

1. A noisemaker assembly, comprising:

an annular horn body having a top surface, a bottom surface, an inner wall, an outer wall and a groove disposed in between said inner wall and said outer wall, wherein said groove is open at said top surface of said annular horn body;

a membrane covering said top surface of said annular horn body;

a tubular mouthpiece that defines a conduit, wherein said tubular mouthpiece extends from said annular horn body and wherein said conduit communicates with said groove;

a housing that defines an internal resonance chamber, said housing having internal ribs, a first set of perforations and a second set of perforations, wherein said annular horn body is completely enveloped within said internal resonance chamber except for a section of said tubular mouthpiece that extends out of said housing; and wherein said ribs engage said annular horn body within said internal resonance chamber and orient said annular horn body so that said first set of perforations are disposed above said both said membrane and said top surface of said horn body, and said second set of perforations are disposed below said bottom surface of said horn body.

2. The assembly according to claim 1, wherein said housing is configured as a sports ball.

3. The assembly according to claim 1, wherein said membrane is an elastomeric film that is stretched over said top surface of said horn body.

4. The assembly according to claim 3, wherein said membrane has a flat central area with a peripheral edge and a lip that extends downwardly from said peripheral edge.

5. The assembly according to claim 4, wherein a brim overhang is disposed on said outer wall proximate said top surface, wherein said lip of said membrane engages said brim overhang when said membrane is stretched over said top surface of said horn body.

6. The assembly according to claim 5, wherein said ribs extend inwardly from said housing that and engage said brim overhang to support said horn body in said internal chamber of said housing.

7. The assembly according to claim 1, wherein said inner wall of said horn body is tapered.

* * * * *